US009068381B2

(12) United States Patent
Segev

(10) Patent No.: US 9,068,381 B2
(45) Date of Patent: Jun. 30, 2015

(54) INTEGRATED SECURITY AND EMERGENCY LOCK

(76) Inventor: Erez Segev, Nofit (IL)

( * ) Notice: Subject to any disclaimer, the term of this patent is extended or adjusted under 35 U.S.C. 154(b) by 616 days.

(21) Appl. No.: 13/293,488

(22) Filed: Nov. 10, 2011

(65) Prior Publication Data

US 2012/0285207 A1 Nov. 15, 2012

Related U.S. Application Data

(63) Continuation-in-part of application No. 11/631,840, filed as application No. PCT/IL2005/000715 on Jul. 6, 2005, now abandoned, application No. 13/293,488, which is a continuation of application No. PCT/IL2009/000614, filed on Jun. 18, 2009.

(60) Provisional application No. 60/585,089, filed on Jul. 6, 2004.

(30) Foreign Application Priority Data

Jun. 19, 2008 (IL) ..... 192350
Jan. 1, 2009 (IL) ..... 196328

(51) Int. Cl.

| | |
|---|---|
| ***E05B 65/10*** | (2006.01) |
| ***E05C 9/06*** | (2006.01) |
| ***E05B 47/06*** | (2006.01) |
| ***E05B 63/16*** | (2006.01) |
| ***E05C 9/16*** | (2006.01) |
| ***E05C 9/10*** | (2006.01) |
| ***E05C 9/14*** | (2006.01) |

(Continued)

(52) U.S. Cl.

CPC ..... *E05C 9/06* (2013.01); *E05B 15/108* (2013.01); *E05B 17/042* (2013.01); *E05B 47/0669* (2013.01); *E05B 63/16* (2013.01); *E05B 65/1086* (2013.01); *E05B 2047/0094* (2013.01); *E05C 9/16* (2013.01); *E05C 9/10* (2013.01); *E05C 9/14* (2013.01)

(58) Field of Classification Search

USPC ..... 292/21, 22, 39, 51, 142, 159, 160, 172, 292/199, 279, 280; 70/107–111

See application file for complete search history.

(56) References Cited

U.S. PATENT DOCUMENTS 1,330,650 A * 2/1920 Pehel ..... 70/134
1,380,117 A * 5/1921 Solaini ..... 70/107

(Continued)

FOREIGN PATENT DOCUMENTS

EP 21820 * 1/1981
WO WO 2006/003661 1/2006

*Primary Examiner* — Carlos Lugo

(74) *Attorney, Agent, or Firm* — Nathan & Associates Patent Agents Ltd.; Menachem Nathan

(57) ABSTRACT

A door locking device for a door cooperating with a door frame includes a cylinder lock and at least one elongated bolt for moving linearly to engage to and disengage from the door frame. A transmission includes an operating wheel for translating circular motion of a rotor of the cylinder lock to a linear motion of the elongated bolt. The transmission includes at least one electromechanical clutch gear that is engagable in response to a trigger signal to enable the circular motion to rotate the operating wheel, and that is disengagable to disable the circular motion from rotating the operating wheel. An emergency unlocking mechanism includes a gear arm that is connected to a handle for turning the operating wheel when the handle is turned, disengaging the elongated bolt from the door frame.

11 Claims, 9 Drawing Sheets

(51) Int. Cl.

| | |
|---|---|
| *E05C 9/12* | (2006.01) |
| *E05B 15/10* | (2006.01) |
| *E05B 17/04* | (2006.01) |
| *E05B 47/00* | (2006.01) |

(56) References Cited

U.S. PATENT DOCUMENTS

| | | | | | |
|---|---|---|---|---|---|
| 1,417,963 | A | * | 5/1922 | Zawistowski | 292/199 |
| 1,511,956 | A | * | 10/1924 | Flagg | 292/172 |
| 1,816,504 | A | * | 7/1931 | Ulrich | 70/262 |
| 2,729,089 | A | * | 1/1956 | Pelcin | 70/151 R |
| 2,765,648 | A | * | 10/1956 | Hatcher | 70/264 |
| 3,991,595 | A | * | 11/1976 | Bahry et al. | 70/120 |
| 4,037,440 | A | * | 7/1977 | Shabtai et al. | 70/108 |
| 4,154,070 | A | * | 5/1979 | Bahry et al. | 70/108 |
| 4,227,723 | A | * | 10/1980 | Rosell | 292/34 |
| 4,237,710 | A | * | 12/1980 | Cardozo | 70/108 |
| 4,248,068 | A | * | 2/1981 | Esser et al. | 70/134 |
| 4,306,432 | A | * | 12/1981 | Ravid | 70/120 |
| 4,362,034 | A | * | 12/1982 | Amgar | 70/108 |
| 4,384,465 | A | * | 5/1983 | Muus | 70/129 |
| 4,606,203 | A | * | 8/1986 | Esser | 70/107 |
| 4,671,089 | A | * | 6/1987 | Fleming et al. | 70/452 |
| 4,784,415 | A | * | 11/1988 | Malaval | 292/144 |
| 4,984,832 | A | * | 1/1991 | Canepa | 292/36 |
| 5,263,749 | A | | 11/1993 | Errani | |
| 5,718,135 | A | | 2/1998 | Bertenshaw et al. | |
| 6,698,263 | B2 | * | 3/2004 | Hsieh | 70/257 |
| 6,923,028 | B2 | * | 8/2005 | Caldwell et al. | 70/56 |
| 7,469,564 | B1 | * | 12/2008 | Shaw | 70/283 |
| 8,056,941 | B2 | * | 11/2011 | Segev et al. | 292/21 |
| 2006/0191303 | A1 | | 8/2006 | Shvarts | |
| 2007/0290789 | A1 | | 12/2007 | Segev et al. | |

* cited by examiner

INTEGRATED SECURITY AND EMERGENCY LOCK

CROSS REFERENCE TO RELATED APPLICATIONS

This application is related to and hereby claims the priority benefit of commonly-owned and co-pending U.S. patent application Ser. No. 11/631,840 titled "Intelligent interactive lock and locking system" and filed Jul. 5, 2007 which claims priority from PCT patent application PCT/IL05/00715 filed Jul. 6, 2005 and U.S. provisional patent application No. 60/585,089 dated Jul. 6, 2004, and of U.S. patent application Ser. No. 12/972,435 titled "Lock with emergency unlocking mechanism" and filed Dec. 18, 2010, which is a Continuation application of PCT patent application PCT/IL2009/000614 which claims priority from IL patent application No. 192350 filed Jun. 19, 2008 and IL patent application No. 196328 filed Jan. 1, 2009, all of which are incorporated herein by reference in their entirety.

FIELD

Embodiments disclosed herein relates to locks. More specifically, embodiments disclosed herein relates to a lock with emergency unlocking and security mechanism.

BACKGROUND

Doors are often held shut by means of a latch mechanism. A latch mechanism is often spring-loaded so that it automatically catches on to a recess in the door jamb when the door is closed. The latch mechanism is released by means of a handle or knob. When the handle is turned, the latch retracts from the recess in the door jamb and allows the door to be opened.

When closed, the door may be described as separating an inner enclosed area from an outer area. When closed, the door is be partially or fully surrounded by straight or curved structural elements making up the various sections of a door frame. The inner side of the door faces the inside area when the door is closed, while the outer side faces the outer area when the door is closed. Perpendicular to both the inner and outer sides of the door are edge surfaces. One edge surface abuts a door jamb when the door is closed. Other edge surfaces of the door may abut other sections of a door frame. In general, door handles are provided on both sides of the door so that the door may be opened from either side. The handle on the inner side of the door may be provided with a handle locking mechanism that locks the latch inside the recess in the door jamb. In this case when the handle locking mechanism is locked, the handle on the outer side of the door cannot be used to open the door. However, simply turning the inside handle overrides the locking mechanism and permits quick exit in case of an emergency.

Where additional security against intruders is required, a door will often be provided with a bolt mechanism. In the case of a relatively simple bolt mechanism, the bolts are inserted into recesses in the door jamb or into structures attached to the door jamb. In the case of a higher security bolt mechanism, additional bolts may be inserted into structures in other parts of the doorframe. Generally, a bolt mechanism does not engage automatically upon closing the door. Rather, in order to engage the bolts, a key is inserted into a keyway and turned, or a knob or handle that is separate from the door handle is turned. In order to disengage the bolts, the key or handle is turned in the opposite direction.

An example of such a bolt mechanism is described in U.S. Pat. No. 3,991,595 (Bahry et al.). Bahry et al. describe a preferred embodiment in which a key-operated cylinder lock turns a wheel that extends four bolts by means of curved links. The bolts extend from various edge surfaces of a door.

In an emergency situation, such as a fire inside a building, it is often necessary to exit quickly. Any delay in opening and exiting through the door could result in serious injury or loss of life. Although a latch mechanism is released simply by turning the door handle, disengaging the bolt mechanism is more time consuming and may require closer attention. Should the bolt release mechanism require a key and the key has been removed form the keyway, excessive time may be required to locate the key and insert it into the keyway. Even if the key is already in the keyway, or a handle is provided for opening the bolt, a panicked individual may waste time in finding the correct direction in which to turn the key or handle. In addition, finding the key or handle on the door may be difficult should the room be dark or filled with smoke.

In addition, some locks are provided with additional security mechanisms. For example, WO 2006/003661 (Segev et al.) describes a lock with an electromechanical element that secures a lock mechanism. The electromechanical element is operative to provide two lock positions upon a proper actuation, and an electromechanical (EM) trigger separate from and coupled to the mechanical element and operative to control the actuation. When included in an intelligent locking system, the lock is remotely controllable through a monitoring and control unit, operative to relay commands to the EM trigger.

It is an object of embodiments disclosed herein to provide a lock with a bolt mechanism and electromechanical lock security device that may be easily and quickly disengaged in the event of an emergency.

Other objects and advantages of embodiments disclosed herein will become apparent after reading the present specification and reviewing the accompanying drawings.

SUMMARY

There is thus provided, in accordance with some embodiments disclosed herein, a door locking device for a door cooperating with a door frame. The device includes a cylinder lock; at least one elongated bolt adapted to move linearly to engage to and disengage from the door frame; a transmission that includes an operating wheel for translating circular motion of a rotor of the cylinder lock to a linear motion of elongated bolt, the transmission comprising at least one electromechanical clutch gear that is engagable in response to a trigger signal to enable the circular motion to rotate the operating wheel, and that is disengagable to disable the circular motion from rotating the operating wheel; and an emergency unlocking mechanism including a gear arm connected to a handle and for turning the operating wheel when the handle is turned, disengaging the elongated bolt from the door frame.

Furthermore, in accordance with some embodiments disclosed herein, the trigger signal is an electromagnetic trigger signal.

Furthermore, in accordance with some embodiments disclosed herein, the trigger signal is generated by a radio frequency identification device.

Furthermore, in accordance with some embodiments disclosed herein, the device includes a latch for engaging with the door frame, wherein the latch is operable by the handle for disengaging the latch from the door frame.

Furthermore, in accordance with some embodiments disclosed herein, the handle is an inside handle, the device further including an outside handle operating only the latch.

Furthermore, in accordance with some embodiments disclosed herein, the inside handle and the outside handle turn coaxially.

Furthermore, in accordance with some embodiments disclosed herein, the inside handle and the outside handle engage separate plates of a door lock nut.

Furthermore, in accordance with some embodiments disclosed herein, the device includes a mechanism for disengaging the clutch wheel when the gear arm is turned.

Furthermore, in accordance with some embodiments disclosed herein, the gear arm includes teeth for engaging with corresponding teeth of the operating wheel.

Furthermore, in accordance with some embodiments disclosed herein, the corresponding teeth of the operating wheel are located on an auxiliary wheel fixed coaxially to the operating wheel.

Furthermore, in accordance with some embodiments disclosed herein, the teeth of the gear arm engage the corresponding teeth of the operating wheel via an intermediary gear wheel, such that rotation of the gear arm causes the operating wheel to rotate in the same direction as the rotation of the gear arm.

Furthermore, in accordance with some embodiments disclosed herein, the elongated bolt includes elongated bolts cooperating with different sections of the door frame.

Furthermore, in accordance with some embodiments disclosed herein, at least three elongated bolts are cooperating with a jamb of the door frame.

Furthermore, in accordance with some embodiments disclosed herein, the device includes a separately actuated catch mechanism used to immobilize the operating wheel and that is released when the handle is turned.

Furthermore, in accordance with some embodiments of Embodiments disclosed herein, the catch mechanism includes an electromagnetic actuator.

Furthermore, in accordance with some embodiments disclosed herein, the catch mechanism is remotely controlled.

Furthermore, in accordance with some embodiments disclosed herein, the locking device includes a Shiryonit Hosen 104/105 locking mechanism.

Furthermore, in accordance with some embodiments disclosed herein, the device includes an electromechanical bolt immobilizer that, when activated by a signal, engages an elongated bolt so as to immobilize the bolt, the emergency unlocking mechanism further including an arm connected to the handle for disengaging the immobilizer from the bolt, such that when the handle is turned, the immobilizer is disengaged from the bolt prior to disengaging the bolt from the door frame.

Furthermore, in accordance with some embodiments disclosed herein, the immobilizer includes a tab for engaging a notch in the bolt.

A locking device according to some embodiments disclosed herein can be implemented exemplarily in a "4-way lock" or in a "multipoint lock". Such a locking device increases security by not allowing an unauthorized person to open a lock from an external side (outside the door) through the action of the electromechanical clutch or electromechanical trigger (also referred to herein as "electromechanical catch") and a valid key. Such a locking device also increases safety in that it allows a person inside a room to quickly open the door in case of emergency by turning the internal handle to simultaneously change the electromechanical clutch position and disengage the bolt from the door frame.

BRIEF DESCRIPTION OF THE DRAWINGS

In order to better understand embodiments disclosed herein, and appreciate their practical applications, the following Figures are provided and referenced hereafter. It should be noted that the Figures are given as examples only. Like components are denoted by like reference numerals.

DETAILED DESCRIPTION OF EMBODIMENTS

Figure 1A:
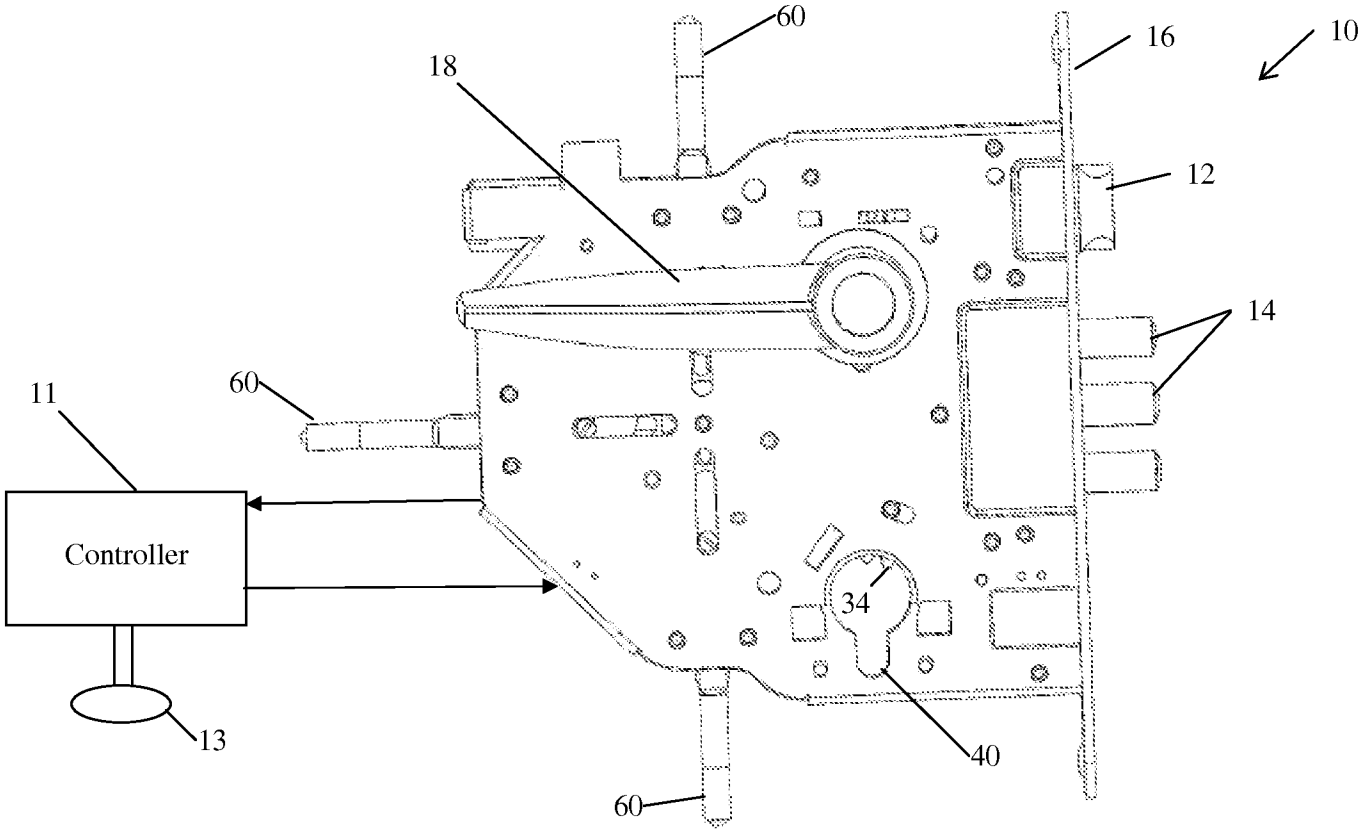
FIG. 1A shows inward facing side of a lock mechanism with emergency unlocking capability that includes an electromechanical lock, in accordance with embodiments disclosed herein, in a locked state.

A lock mechanism in accordance with embodiments disclosed herein may include a bolt mechanism. The lock mechanism may also include a latch mechanism. A spring causes a latch of the latch mechanism to engage a door jamb when the door is closed. The latch is disengaged by turning a door knob or handle from either side of the door. When locked, the bolt mechanism extends elongated bolts that engage recesses or other structures in the door jamb. Bolts may also engage structures in other elements of a doorframe. The terms "door jamb" and "doorframe" herein refer to structural elements that support, abut or engage the door, for example, the inner surfaces of the opening in the wall in which the door is placed, or a doorframe that is attached to the inner surfaces of that opening. The bolts may be engaged or disengaged from either side of the door through the use of a key. Alternatively, a bolt mechanism may be operated by means of a handle or knob from the inside, and by means of a key from the outside. In order to enable quick unlocking of the door in an emergency situation, both the bolts and the latch may be disengaged by turning the inside door handle. For example, the inside handle may be coupled via a gear to an operating wheel of a transmission mechanism for disengaging the bolts from the doorframe. Turning the outside door handle only disengages the latch. Therefore, when the bolts are engaged, the door cannot be opened from the outside by means of the door handle alone.

A lock mechanism in accordance with embodiments disclosed herein may be further provided with one or more electromechanical lock security devices. An electromechanical security device may prevent an unauthorized person from opening the lock unless an appropriate electromagnetic trigger signal is provided. A trigger signal may be provided by a trigger device. For example, a trigger device may include an appropriately configured remote control unit or a radio frequency identification (RFID) unit or circuit. For example, the trigger device may be embedded in the handle, or another part, of an authorized key, or in a separate unit. For example, a transmitter associated with the electromechanical security device may emit an electromagnetic signal either continuously or when operated by a user. An RFID unit of the trigger device may then receive, modulate, and retransmit a signal detectable by detector associated with the electromechanical security device. The electromechanical security device may then enable the lock to open. Alternatively, the trigger device may emit an electromagnetic signal that may be detected by the detector.

For example, the electromechanical security device may include an electromechanically operated clutch mechanism. When the clutch is disengaged, rotation of the cylinder may not cause the lock to open. For example, a clutch mechanism may disengage the cylinder from an operating wheel or gear of the lock mechanism whenever the lock is locked. An appropriate trigger signal or trigger may then cause the clutch to engage so as to engage the cylinder with the remainder of the lock mechanism. For example, the cylinder may engage an operating wheel of the lock. When the cylinder is engaged, rotating the cylinder may then unlock the lock.

Such a clutch mechanism may be temporarily or permanently disabled at times. For example, loss of electrical power may cause the clutch mechanism to be engaged until power is restored. An engaged clutch mechanism could interfere with the operation of an emergency unlocking mechanism. For example, an engaged cylinder may interfere with rotation of an operating wheel by an emergency unlocking mechanism. Therefore, am emergency unlocking mechanism may be configured to disengage the clutch when operated. For example, the emergency unlocking mechanism may push a clutch gear that engages both the cylinder and the operating wheel away from the cylinder, the operating wheel, or both.

A lock mechanism in accordance with some embodiments disclosed herein may include an additional electromechanical security device. For example, an electromechanically operated catch may prevent a transmission mechanism from withdrawing the bolts from the door jamb and doorframe unless the appropriate electromagnetic signal or trigger is provided. For example, the catch may prevent rotation of an operating wheel or gear associated with the transmission mechanism. An emergency unlocking mechanism may be configured to neutralize the catch, for example, by pushing the catch away from the wheel or gear.

Reference is now made to the accompanying Figures.

FIG. 1A shows inward facing side of a lock mechanism with emergency unlocking capability that includes an electromechanical lock, in accordance with embodiments disclosed herein, in a locked state. Lock mechanism 10 may be mounted within a cavity within a door (not shown). Lock mechanism 10 may be mounted such that faceplate 16 is flush with the edge surface of the door that faces the door jamb (not shown) when the door is closed. The spindle (not visible) of inner door handle 18 may be inserted into inner spindle opening 20*a* (visible in FIG. 2A). Similarly, the spindle of an outer door handle (not shown) may be inserted into outer spindle opening 20*b* (FIG. 2B). The spindles of the inner door handle and the outer door handle may be collinearly mounted on a single axis in such a manner as to rotate independently of each other about the axis. Alternatively, the spindles of inner door handle 18 and the outer door handle may be separate, each separately inserted into a separate spindle opening.

As shown in FIG. 1A, lock mechanism 10 is in an engaged locked state. Latch 12, bolts 14, and rods 60 are all extended. When lock mechanism 10 is in a locked state while the door is closed, the extended latch 12 and bolts 14 may fit into and engage structures in the door jamb. Engaging the structures in the door jamb locks the door and prevents it from being opened. Additional bolts in the form of long rods, such as a rod 60 (only a proximal section of each rod 60 is shown) extend to engage other parts of the doorframe. When the door is locked, rods 60 are extended. Extending rods 60 inserts the distal ends (not shown) of rods 60 into corresponding structures in the doorframe (not shown). The rods 60 provide additional security against forced entry through the door. A locking mechanism as described is found, for example, in lock model 104/105 produced by Shiryonit Hosen Ltd.

Lock mechanism 10 may include one or more electromechanical security devices (described below). The electromechanical security devices are controlled by controller 11. For example, controller 11 may include one or more cooperating components that include analog or digital electronic circuit devices. Controller 11 may also include a battery or other power source for providing electric power to the electromechanical security devices. For example, when lock mechanism 10 is locked, a component of lock mechanism 10 may generate an appropriate signal to controller 11. Controller 11 may then control the electromechanical security devices to the secure lock mechanism 10 in the locked state.

In order to unlock lock mechanism 10 from outside the door, a key is inserting a key into a keyway of a cylinder lock (not shown) mounted in cylinder bracket 40. Concurrently, a passive or active trigger device may be operated so as to generate an appropriate electromagnetic trigger signal. For example, the trigger device may be a passive RFID device mounted within the key that generates a trigger signal when operated by a signal emitted by controller 11. The trigger signal may be received by antenna 13. In response to the received trigger signal, controller 11 may control the electromechanical security devices so as to enable unlocking of lock mechanism 10. Rotation of the key may then retract bolts 14 and rods 60 from the doorframe. Turning the outer door handle may then retract latch 12 from the door jamb, enabling the door to open.

On the other hand, turning the outer door handle only, without generating a trigger signal and without turning a key in the keyway, a disengages only latch 12 from the door jamb. Bolts 14 and rods 60 remain engaged in the doorframe, preventing the door from opening.

Figure 1B:
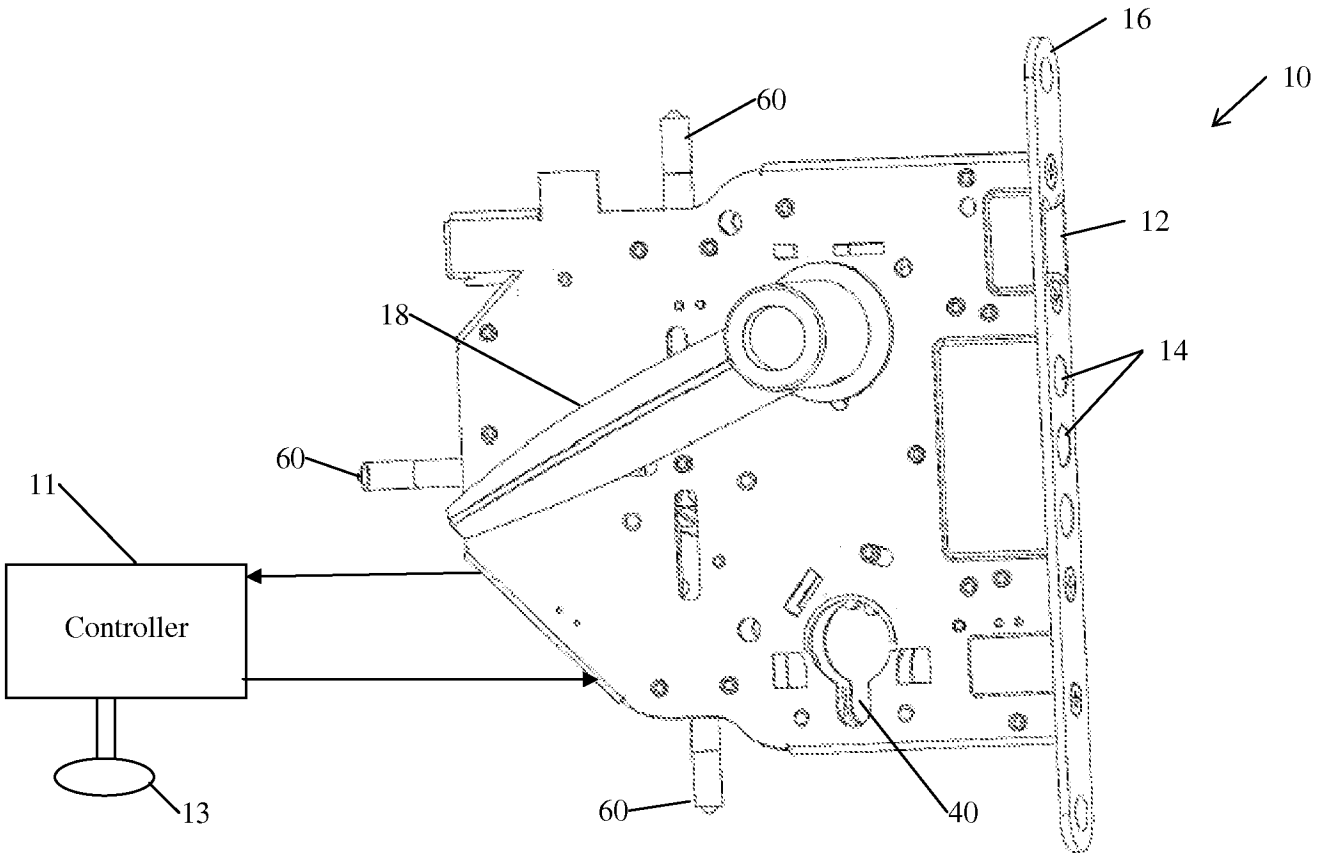
FIG. 1B shows the inward facing side of the lock mechanism shown in FIG. 1A in an unlocked state.

A lock mechanism in accordance with embodiments disclosed herein is provided with an emergency unlock mechanism that is operated by inner door handle 18 alone. Turning inner door handle 18 unlocks lock mechanism 10 by retracting latch 12, bolts 14, and rods 60. FIG. 1B shows the inward facing side of the lock mechanism shown in FIG. 1A in an unlocked state.

Figure 2A:
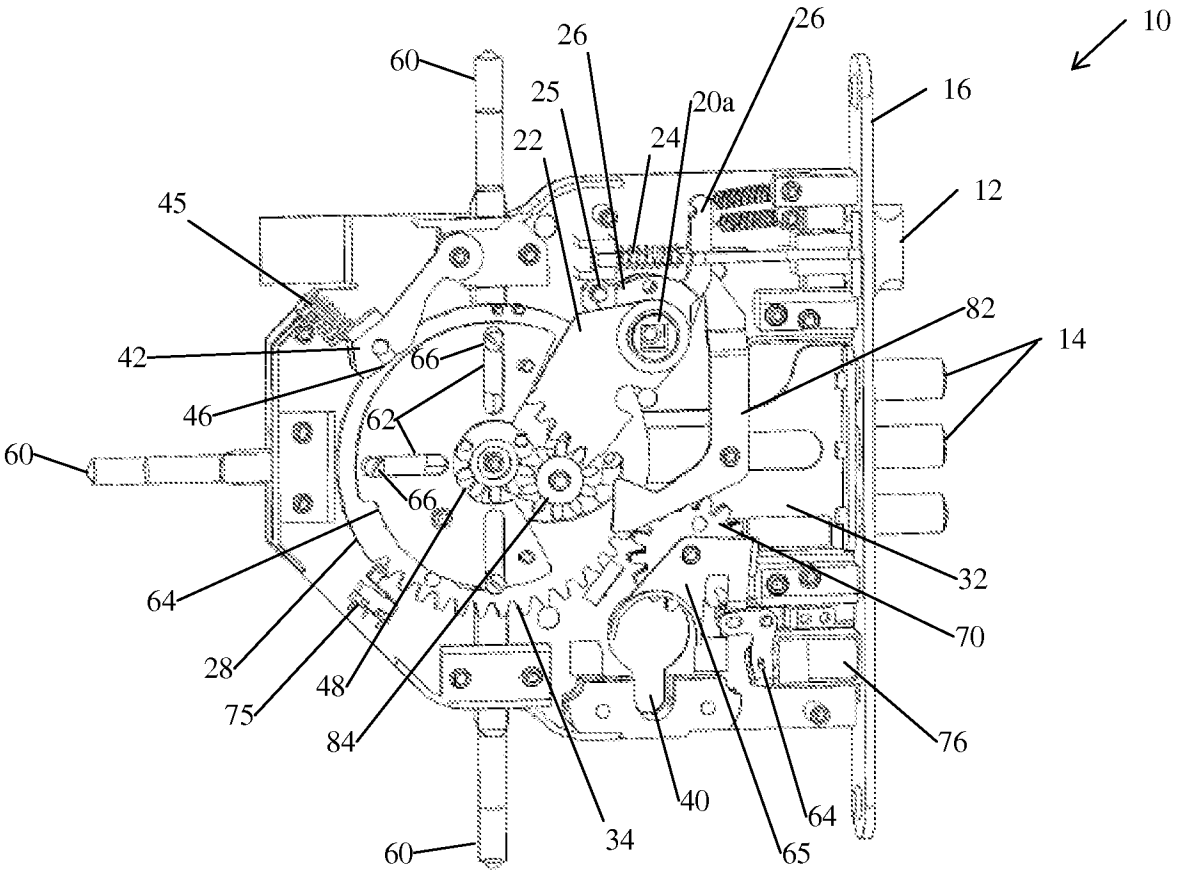
FIG. 2A shows the inward facing side of the interior of the lock mechanism shown in FIG. 1A, in a locked state.
Figure 2B:
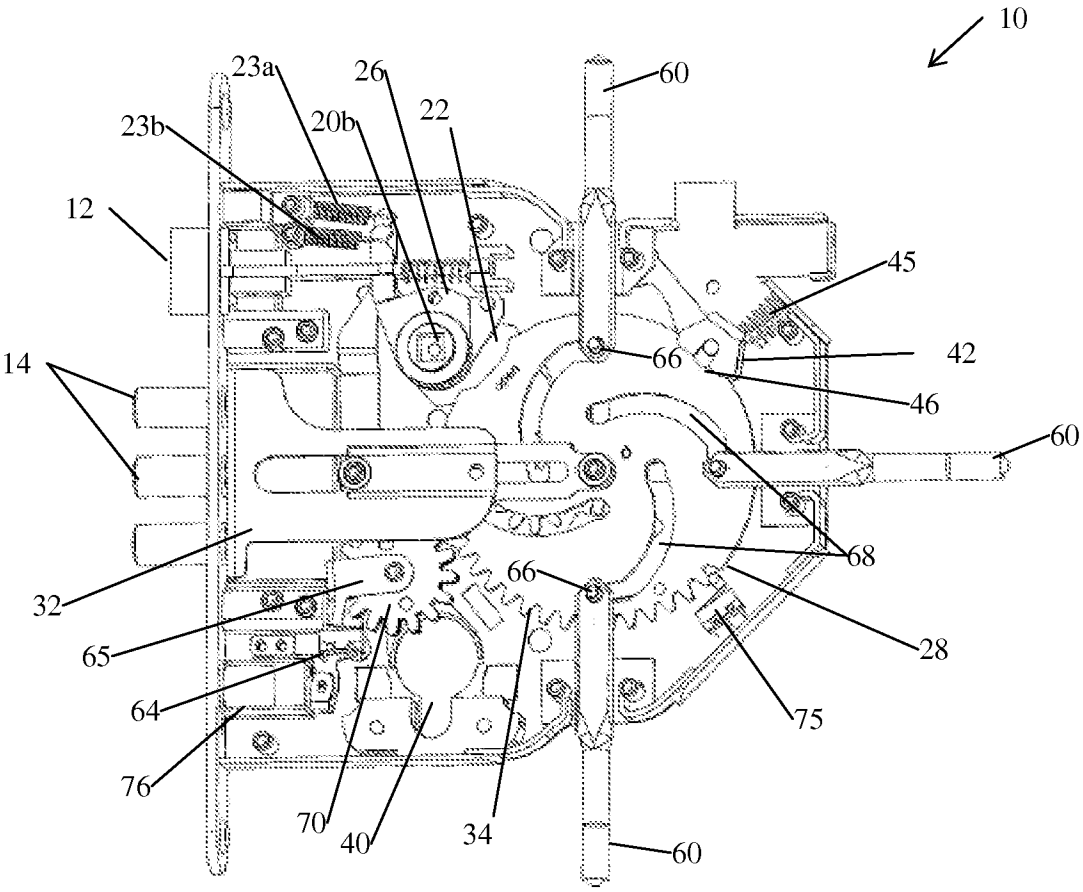
FIG. 2B shows the outward facing side of the interior of the lock mechanism shown in FIG. 2A, in a locked state.

FIG. 2A shows the inward facing side of the interior of the lock mechanism shown in FIG. 1A, in a locked state. FIG. 2B shows the outward facing side of the interior of the lock mechanism shown in FIG. 2A, in a locked state. The spindle of inner door handle 18 (FIG. 1A) may be inserted into inner spindle opening 20*a*. Inner spindle opening 20*a* is coupled mechanically to gear arm 22 via door lock nut 26 such that rotation of inner spindle opening 20*a* rotates gear arm 22. The spindle of an outer door handle (not shown) may be inserted into outer spindle opening 20*b*. Outer spindle opening 20*b* is not coupled to gear arm 22. Thus, rotation of outer spindle opening 20*b* is independent of rotation of gear arm 22. Although both inner spindle opening 20*a* and outer spindle opening 20*b* are coaxial about a single spindle axis, they rotate independently of one another. Therefore, inner door handle 18 or the outer door handle may function independently of one another, and each may each be turned without turning the other.

Spring loaded arm 42 is pressed by spring 45 against operating wheel 28. When lock mechanism 10 is locked, spring loaded arm 42 may engage notch 46 on operating wheel 28. Thus, spring loaded arm 42 may prevent accidental or unintentional motion of operating wheel 28.

Figure 3:
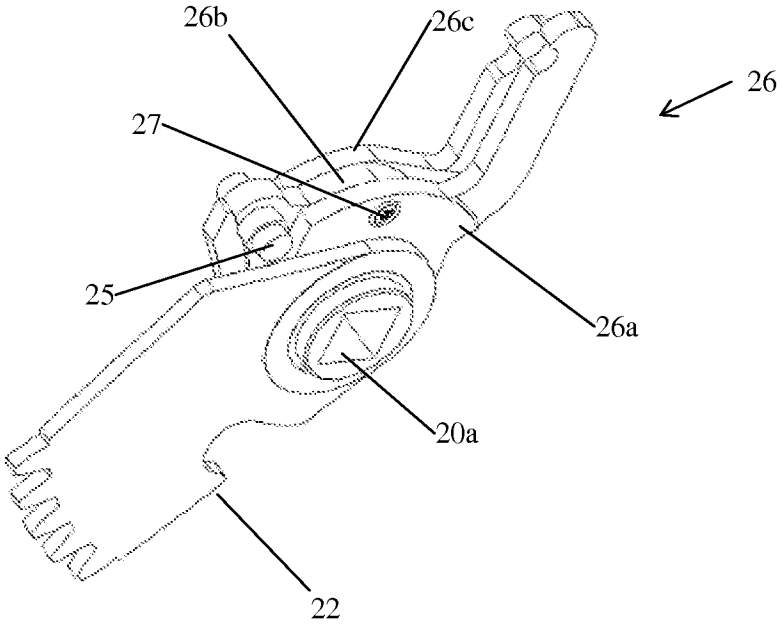
FIG. 3 shows an enlarged view of a door lock nut of the lock mechanism shown in FIG. 2A.

FIG. 3 shows an enlarged view of a door lock nut of the lock mechanism shown in FIG. 2A. Door lock nut 26 includes three separate cooperating plates, inner plate 26*a*, middle plate 26*b*, and outer plate 26*c*. Screw 27 connects inner plate 26*a* to middle plate 26*b* so that they rotate together. As described below, rotation of middle plate 26*b* operates the emergency unlocking mechanism by means of pin 25 on middle plate 26*b*. When middle plate 26*b* rotates, pin 25 presses on gear arm 22, causing gear arm 22 to rotate. Outer plate 26*c* is free to rotate with respect to middle plate 26*b* and inner plate 26*a*. Inner plate 26*a* includes inner spindle opening 20*a* into which the spindle of the inner door handle 18 (FIG. 1A) may be inserted. Rotating inner door handle 18 rotates inner plate 26*a* and middle plate 26*b*. Thus, as described below, rotating the inner door handle operates the emergency unlocking mechanism. Inner spring 23*a* (FIG. 2B) tends to restore inner plate 26*a*, middle plate 26*b*, and the inner door handle to their original positions. Outer plate 26*c* includes outer spindle opening 20*b* (FIG. 2B) into which the spindle of the outer door handle may be inserted. Rotating the outer door handle rotates outer plate 26*c*. Since outer plate 26*c* rotates independently of middle plate 26*b*, rotating the outer door handle does not operate the emergency unlocking mechanism. Outer spring 23*b* (FIG. 2B) tends to restore outer plate 26*c* and the outer door handle to their original positions.

Screw 27 may be detached from inner plate 26*a* and middle plate 26*b*, and reinserted so as to connect outer plate 26*c* to middle plate 26*b*. In such a case, the lock is reconfigured so that formerly outer plate 26*c* functions as an inner plate as described above. Such reconfiguration may be necessary, for example, in adapting the lock to a door that opens in the opposite direction. Plates 26*a*, 26*b* and 26*c* are mounted coaxially. In an alternative embodiment only the plates which are coupled by screw 27 (plates 26*a* and 26*b* in FIG. 3, or plates 26*b* and 26*c* in an alternative configuration) are coaxially mounted.

The spindles of inner door handle 18 and the outer door handle may be collinearly mounted on a single axis in such a manner as to rotate independently about the axis. Alternatively, the spindles of inner door handle 18 and the outer door handle may be separate, each separately inserted into a separate spindle opening.

As shown in FIG. 2A and FIG. 2B, lock mechanism 10 is in an engaged locked state. Latch 12, bolts 14, and rods 60 are all extended. Bolts 14 are mounted on bolt arm 32. Extension or retraction of bolt arm 32 and rods 60 is governed by operating wheel 28. Locking rotation of operating wheel 28 (clockwise in FIG. 2A, counterclockwise in FIG. 2B) puts lock 10 into its locked state. The opposite, unlocking rotation of operating wheel 28 results in an unlocked state.

A guide pin 66 is affixed to a proximal end of each rod 60 and of bolt arm 32. Each guide pin 66 extends through, and is confined by, a slot 62 in slot plate 64. Each guide pin 66 also extends through and is confined by a curved slot 68 in operating wheel 28. Therefore, when operating wheel 28 is rotated in a locking direction (clockwise as viewed in FIG. 2A, counterclockwise in FIG. 2B), the curved shape of curved slot 68 causes guide pin 66 to travel outward along slot 62. The outward travel of guide pin 66 extends bolt arm 32 and each rod 60. Conversely, an unlocking rotation of operating wheel 28 (counterclockwise as viewed in FIG. 2A, clockwise in FIG. 2B) retracts bolt arm 32 and each rod 60.

Lock mechanism 10 may include a cylinder lock (not shown) mounted in cylinder bracket 40. The cylinder lock may be used to rotate operating wheel 28, thus locking or unlocking the door. Alternatively, an inward facing end of the cylinder lock may be provided with a knob or handle that enables rotation of the cylinder lock from that end without insertion of a key.

In accordance with embodiments disclosed herein, lock mechanism 10 may be further secured in a locked state by a electromechanical clutch security device. Typically, when lock mechanism 10 is locked, operating wheel 28 or teeth 34 of operating wheel 28 activate switch 75. When switch 75 is activated, electromechanical clutch actuator 76 (typically including an electromechanical solenoid) causes disengaging rotation of clutch lever 64. Disengaging rotation of clutch lever 64 causes clutch gear housing 65 to disengage clutch gear 70 from teeth 34 on operating wheel 28. Thus, when lock mechanism 10 is in a locked state, turning the cylinder lock engaging clutch gear 70 cannot unlock lock mechanism 10.

In order to unlock lock mechanism 10 using a key in the cylinder lock, an appropriate electromagnetic trigger signal must be generated. In response to the trigger signal, electromechanical clutch actuator 76 rotates clutch lever 64 with an engaging rotation. The engaging rotation of clutch lever 64 causes gear housing 65 to engage clutch gear 70 with teeth 34 on operating wheel 28. Thus, rotation of a cylinder lock engaging clutch gear 70 may rotate operating wheel 28 to unlock or lock gear mechanism 10.

When circumstances require, the electromechanical clutch security device may be configured such that clutch gear 70 remain engaged to teeth 34 even when the door is locked. Such circumstances may include, for example, when a power supply associated with controller 11 (FIG. 1A) is depleted or interrupted, or when other considerations preclude generation of the trigger signal. When clutch gear 70 is mechanically disengaged, as described below, an additional spring (not shown) or intermittent activation of clutch actuator 76, may cause clutch gear 70 to reengage.

Rotation of middle plate 26*b* (FIG. 3) of door lock nut 26 may cause rotation of clutch override lever 82. Rotation of clutch override lever 82 may cause clutch override lever 82 to press against gear housing 65 so as to ensure that clutch gear 70 is disengaged from teeth 34 of operating wheel 28. For example, if the electromechanical clutch security device is configured such that clutch gear 70 is always engaged, the emergency unlocking mechanism may still enable unlocking of the door.

Figure 4A:
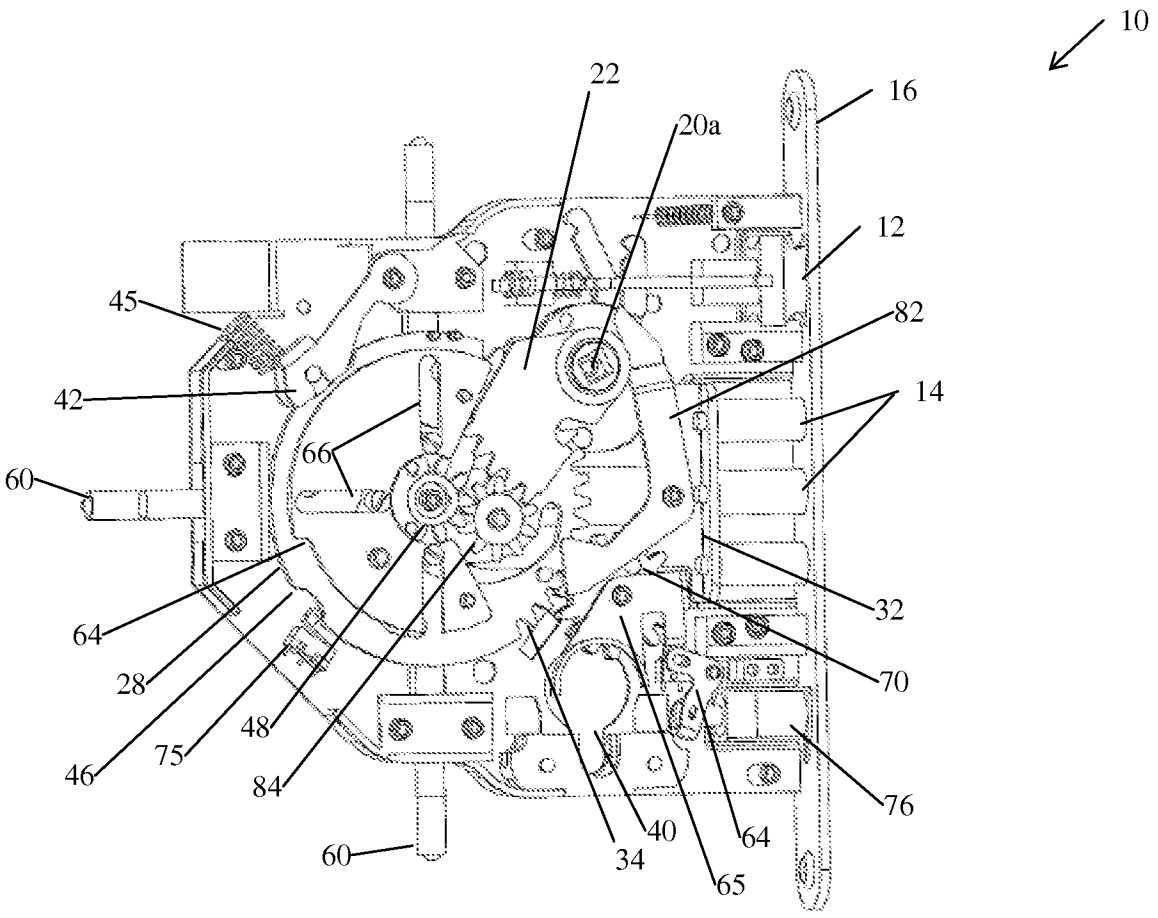
FIG. 4A shows the inward facing side of the interior of the lock mechanism shown FIG. 1B, in an unlocked state.
Figure 4B:
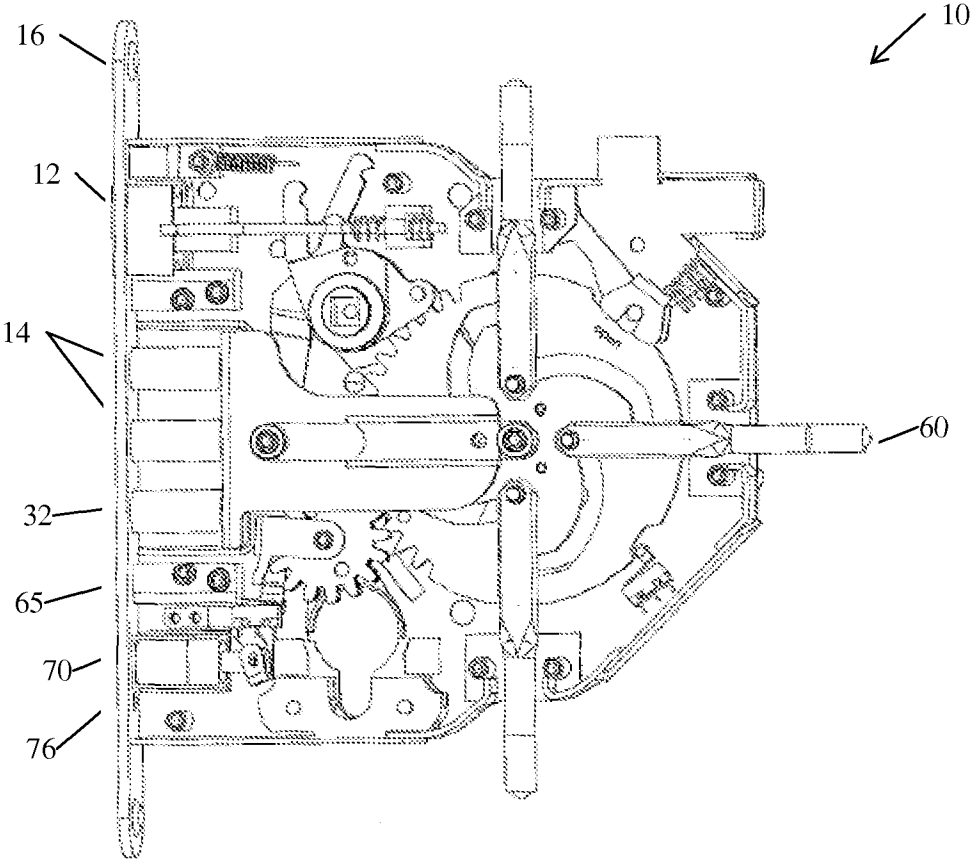
FIG. 4B shows the outward facing side of the interior of the lock mechanism shown in FIG. 4A, in an unlocked state.

Turning of inner door handle 18 further or concurrently causes pin 25 to press against and rotate gear arm 22. Rotation of gear arm 22 may cause transmission gear 84 to rotate. Rotation of transmission gear 84 may cause auxiliary gear 48 of operating wheel 28 to rotate, rotating operating wheel 28 with an unlocking rotation. Rotation of operating wheel 28 with an unlocking rotation may then cause bolts 14, rods 60, and latch 12 to disengage from a doorframe, enabling the door to open. FIG. 4A shows the inward facing side of the interior of the lock mechanism shown FIG. 1B, in an unlocked state. FIG. 4B shows the outward facing side of the interior of the lock mechanism shown in FIG. 4A, in an unlocked state.

Figure 5A:
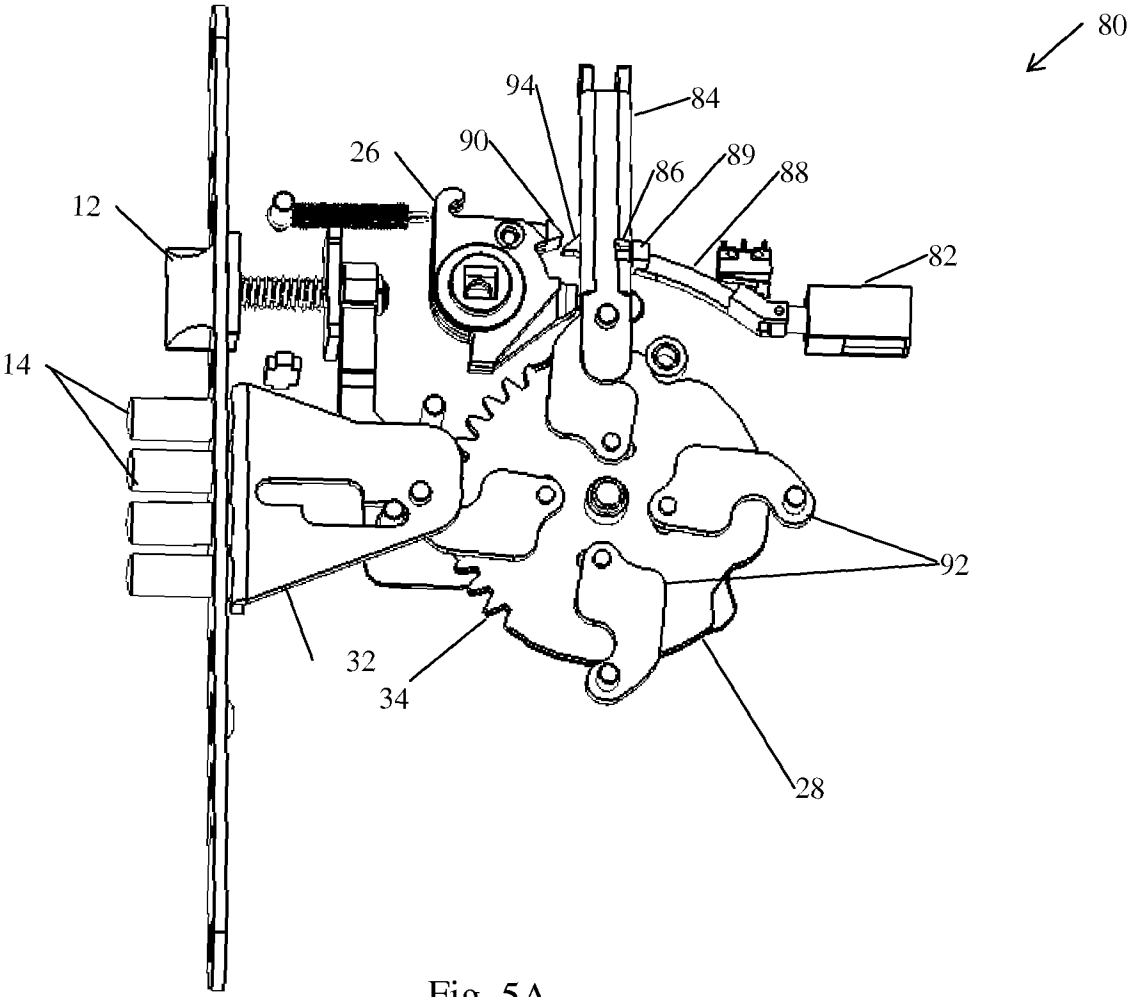
FIG. 5A shows a lock mechanism with emergency unlocking capability that includes an electromechanical bolt locking mechanism, in accordance with some embodiments disclosed herein, in a locked state.

A lock mechanism, in accordance with some embodiments disclosed herein, may be provided with an electromagnetically activated bolt locking mechanism. FIG. 5A shows a lock mechanism with emergency unlocking capability that includes an electromechanical bolt locking mechanism, in accordance with some embodiments disclosed herein, in a locked state.

In lock mechanism 80, a bolt rod 84 is provided with a notch 86. Electromechanical bolt lock actuator 82 may extend bolt locking arm 88 in response to an appropriate electromagnetic signal. For example, electromechanical bolt lock actuator 82 may operate in accordance with principles described in WO 2006/003661. Extending bolt locking arm 88 when bolt rod 84 is extended (e.g. engaging a door frame so as to lock a door) causes bolt locking tab 89 to engage notch 86. Engaging notch 86 with bolt locking tab 89 locks bolt rod 84 in place, preventing retraction of bolt rod 84 (e.g. unlocking a door).

When opening lock mechanism 80 from the outside, electromechanical bolt lock actuator 82 may be activated by an appropriate electromagnetic signal to retract bolt locking arm 88. Retracting bolt locking arm 88 withdraws bolt locking tab 89 from notch 86 in bolt rod 84. When bolt locking tab 89 is withdrawn from notch 86 (and any other electromagnetically activated locking mechanisms are opened), a key may be used (as described above) to retract bolt rod 84 (as well any other rods 60 or bolts 14).

When lock mechanism 80 is opened from the inside, as part of an emergency unlocking mechanism, turning an inner door handle pushes bolt locking tab 89 out of notch 86 prior retracting bolt rod 84 (as well as other rods 60 and bolts 14). The emergency unlocking mechanism shown, based on an operating wheel 28 and rod extending arms 92, is similar to that described by Segev et al. in WO 2009/153797.

Figure 5B:
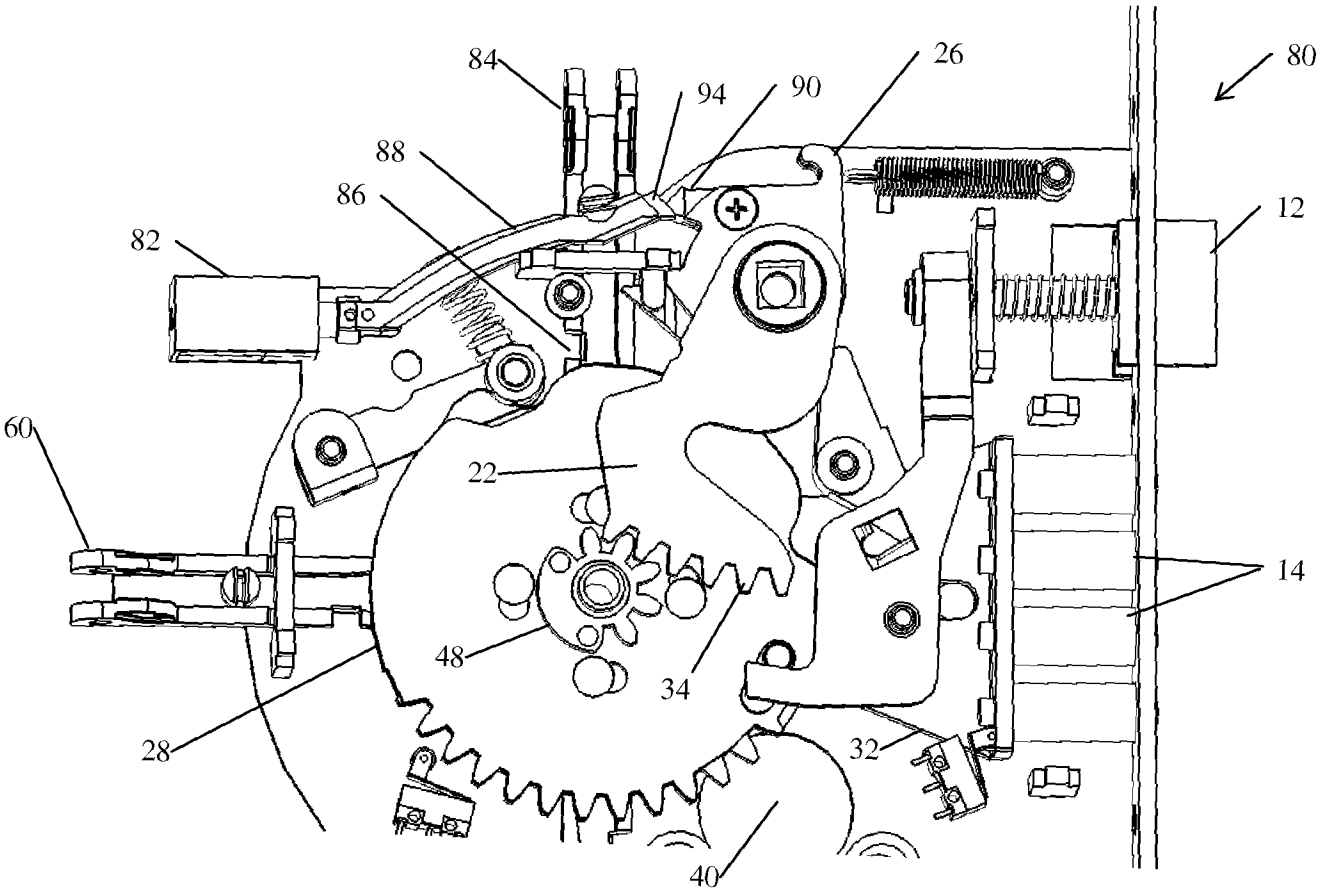
FIG. 5B shows the lock mechanism of FIG. 5A in an unlocked state, and viewed from the opposite side.

FIG. 5B shows the lock mechanism of FIG. 5A in an unlocked state, and viewed from the opposite side. Lock nut 26 is configured (as described above) such that an appropriate arm, such as lock nut extension 90, is coupled to an inner door handle, and not to an outer door handle. When the inner door handle is turned, lock nut 26 pushes lock nut extension 90 against arm end 94. Lock nut extension 90 thus pushes bolt locking arm 88 such that bolt locking tab 89 is pushed out of notch 86. Continued turning of the inner door handle causes gear arm 22 to rotate operating wheel 28, thus retracting all rods 60 and bolts 14, and thus unlocking the door. Thus, the door may be opened from the inside without activating electromechanical bolt lock actuator 82.

Thus, a door lock mechanism is provided with a clutch security device that disables a cylinder lock of the lock mechanism in the absence of an appropriate triggering signal. The lock mechanism enables unlocking the door from the inside by turning the door handle alone.

The invention claimed is:

1. A door locking device for a door cooperating with a door frame, the device comprising:

a) a cylinder lock;

b) at least one elongated bolt for moving linearly to engage to and disengage from the door frame;

c) a transmission comprising an operating wheel for translating a circular motion of a rotor of the cylinder lock to a linear motion of said at least one elongated bolt, the transmission comprising an electromechanical clutch security device including a clutch actuator and a clutch lever coupled to a clutch gear and a switch, the clutch lever and clutch gear being disengaged from the operating wheel when the switch is activated upon locking of the locking device and being engaged with the operating wheel when the locking device is unlocked;

d) an emergency unlocking mechanism comprising a gear arm connected to a handle for turning the operating wheel when the handle is turned, the turning of the operating wheel disengaging the at least one elongated bolt from the door frame; and e) a controller for controlling the electromechanical clutch security device.

2. The device as claimed in claim 1, wherein the trigger signal is an electromagnetic trigger signal.

3. The device as claimed in claim 2, wherein the trigger signal is generated by a radio frequency identification device.

4. The device as claimed in claim 1, wherein said at least one elongated bolt comprises elongated bolts cooperating with different sections of the door frame.

5. The device as claimed in claim 4, wherein at least three elongated bolts of said at least one elongated bolt are cooperating with a jamb of the door frame.

6. The device as claimed in claim 1, comprising a separately actuated catch mechanism used to immobilize the operating wheel and that is released when the handle is turned.

7. The device as claimed in claim 6, wherein the catch mechanism comprises an electromagnetic actuator.

8. The device as claimed in claim 7, wherein the catch mechanism is remotely controlled.

9. The device as claimed in claim 1, wherein the locking device comprises a Shiryonit Hosen 104/105 locking mechanism.

10. The device as claimed in claim 1, wherein the device comprises an electromechanical bolt immobilizer that, when activated by a signal, engages a bolt of said at least one elongated bolt so as to immobilize the bolt, the emergency unlocking mechanism further comprising an arm connected to the handle for disengaging the immobilizer from the bolt, such that when the handle is turned, the immobilizer is disengaged from the bolt prior to disengaging the bolt from the door frame.

11. The device as claimed in claim 10, wherein the immobilizer comprises a tab for engaging a notch in the bolt.

* * * * *